United States Patent [19]

Moineau

[11] 4,084,624

[45] Apr. 18, 1978

[54] METHOD OF FABRICATING A POT HANGER

[75] Inventor: Hubert J. Moineau, Bolton, Mass.

[73] Assignee: Automatic Specialties, Inc., Marlboro, Mass.

[21] Appl. No.: 789,936

[22] Filed: Apr. 22, 1977

Related U.S. Application Data

[62] Division of Ser. No. 645,808, Dec. 31, 1975.

[51] Int. Cl.[2] ..... B21F 15/04; B21F 45/00

[52] U.S. Cl. ..... 140/80; 140/115; 140/124; 140/149

[58] Field of Search ..... 47/67; 140/36, 80, 81.5, 140/111, 115, 124, 149; 211/119; 248/303, 318, 339; 223/88

[56] References Cited

U.S. PATENT DOCUMENTS

| | | | |
|---|---|---|---|
| 225,020 | 3/1880 | Pettengill | 248/318 |
| 770,738 | 9/1904 | Chessman | 248/318 |
| 919,173 | 4/1909 | Hurff | 211/119 X |
| 2,152,109 | 3/1939 | Todd | 140/81.5 |
| 2,370,313 | 2/1945 | Isaak | 223/88 |
| 2,430,805 | 11/1947 | Coker | 140/81.5 |
| 2,949,939 | 8/1960 | Milla | 140/115 |

FOREIGN PATENT DOCUMENTS

| | | | |
|---|---|---|---|
| 2,284,204 | 9/1974 | France | 140/124 |
| 879,873 | 6/1953 | Germany | 140/149 |

*Primary Examiner*—E. M. Combs
*Attorney, Agent, or Firm*—Richard P. Crowley

[57] ABSTRACT

An improved wire pot hanger and method of manufacturing the same, which hanger comprises a large-diameter wire-supporting element having a hook-like shape at the one end and a shank portion extending therefrom at the other end, a plurality of smaller-diameter wires, each of the wires having a one and another end, the wires at the one end formed into hook-like shapes adapted to be secured to or to support a pot-like planter or a similar container, the other end of the wires forming a helical coil about at least the shank portion of the larger-diameter hook-like supporting element, the helical coil wrapped about the shank element to prevent the helical coil of the smaller-diameter wires from slipping from such element in use.

10 Claims, 6 Drawing Figures

METHOD OF FABRICATING A POT HANGER

This is a division of application Ser. No. 645,808, filed Dec. 31, 1975.

BACKGROUND OF THE INVENTION

Planters which comprise a container, such as a pot, for holding soil and plants have been suspended and supported by a number of different wire-type hanger devices. Such hanger devices generally comprise a sturdy hook-like element at the one end which is secured to a bracket or a ceiling device to suspend the planter, while at the other end of the wire hanger, a plurality of generally two, three, four or more extending stringer wires are secured to the planter to hold the planter in position. Typically the ends of the plurality of wire elements are bent into hook-like forms or are otherwise twisted or engaged through or to or about the rim of the planter pot.

At present, there are a number of wire pot hangers in use, none of which are wholly satisfactory from an ease-of-manufacture, a cost, an aesthetic or a stability-in-use standpoint. One type of wire pot hanger comprises a hanger wherein the plurality of wires is twisted together at one end and then bent back on each other to form a hook element to suspend the planter. This type of wire pot hanger often is deficient in strength, since it depends upon the twisted and bent-back smaller-diameter wires to form the supporting hook-like element, requires a number of bending and twisting operations and is aesthetically not wholly desirable.

A second type of wire pot hanger presently in use includes a preformed, hollow, aluminum hook element forming the supporting element of the pot hanger, and wherein a plurality of smaller-diameter wires is inserted into the open shank portion of the hollow aluminum hook element, and then the external portion of the aluminum hook element clamped or swaged about the wires to secure the plurality of supporting wires in place. This type of wire pot hanger requires a preformed hook element and the operation of inserting of the wires into the one open end and a clamping or swaging operation to secure the wires in place. Further, this type of element is often subject to failure by the wires coming loose, particularly when a heavy planter containing the soil is secured therefrom.

Another type of wire pot hanger presently employed also includes a preformed hook-like supporting element, wherein a plurality of wire elements is welded to the lower or shank portion of the preformed hook element. This type of hook element requires a welding operation and also is aesthetically undesirable.

Accordingly, there exists a need for an improved wire pot hanger for planters and similar containers, and which hanger can be easily prepared at low cost and yet which provides adequate support and is aesthetically pleasing.

SUMMARY OF THE INVENTION

My invention relates to an improved pot hanger, the method of manufacturing the pot hanger and to a planter employing such pot hanger. In particular, my invention is concerned with an improved wire-type pot hanger which is easily and cheaply manufactured and which is strong, enabling it to support soil-filled planters and which is aesthetically pleasing, and to the method of manufacturing and using such improved wire pot hanger.

My improved wire pot hanger is adapted to support planters or similar containers in a stable suspended position. My pot hanger comprises in combination a strong supporting element, such as a large-diameter rod or wire element as a supporting element, having a one end and another end, and which is formed into a hook-like shape at the one end. The supporting hook-like element typically is characterized by an angular portion thereof and then a straight-line shank extending therefrom at the other end. The hanger includes a plurality of supporting wire elements, such as smaller-diameter flexible wire stringer elements, each of the wire elements having a one end and another end, with each of the wires at the other end adapted to have or having a means to secure that end of the wire to the planter or other container or object to be supported. One means would include hooks at the other end which are adapted to be secured to eyelets or holes or other securing means to the or about the rim of the planter, and typically are equally positioned about the rim of the planter to provide stability thereto. If desired, the wire stringer elements at the end may be straight as supplied and be sufficiently flexible to be secured by the user to the pot by bending, twisting or otherwise securing the wire ends to the object to be supported.

The stringer wire elements at the one end are wrapped in a contacting generally contiguous sequential fashion as a helical coil about the one end of the hook-like supporting element, and at least a portion of the shank portion of the hook-like shape. Preferably, the helical coil formed from the plurality of wire elements extends in one embodiment from the shank to the angular extension of the shank portion of the supporting means. In another embodiment of my invention, the helical coil extends only about the straight-line shank section of the supporting element and is tightly wrapped about the element to prevent the coil from slipping off the shank portion of the hook-like element. In a further embodiment, the shank portion may be modified, such as by surface corrugations or the like, or adhesive used to prevent the helical coil of the wire elements from slipping from such shank portion, in the event that the tightly wound helical coil is insufficient only to prevent the coil from slipping off, such as where very heavy objects are to be suspended.

My invention also comprises the method of preparing and forming my improved pot hanger, which method comprises surrounding or positioning about one end of a straight supporting wire from which the hook-like element is to be formed, such as a large-diameter straight wire of predetermined length, a plurality of the supporting wire elements, such as the smaller-diameter stringer wires, typically of a longer length. The wire elements may be positioned about the supporting wire, for example, by employing a positioning tool, such as a chuck-like element, having a plurality of prepositioned holes therein, which preposition the wire equally or as desired about the central wire supporting element. My method includes twisting the smaller-diameter wires about the one end portion of the supporting wire, such as the large-diameter wire, to form a tight helical coil of the smaller-diameter wires at the other end of the supporting wire which is later to form the shank and angular extension of the hook-like support element.

In the preferred embodiment, the chuck or means to position employed to preposition the wire elements about the supporting wire is rotated about the supporting wire and moved longitudinally thereof so as to form a one-layer helical coil of the stringer wire elements about the central supporting wire, and thereafter removed axially from the other free end of the straight supporting wire prior to formation of the larger-diameter wire into the hook-like supporting element.

My method also includes optionally forming the other ends of the wire elements, such as the smaller-diameter wires, into the desired securing means, whereby such ends may be secured to support an object like a planter. For example, the other ends of the smaller-diameter wires may be then formed singly or together into a hook in one operation prior to being spread into an angular position for use, or secured by twisting or other techniques by the user of the planter. The other end of the supporting wire, after formation of the helical coil, is then formed, such as bending, into a hook-like or other supporting shape, for example, which has an angular extension thereof extending into a straight-line shank section.

In the most preferred embodiment of my invention, the supporting wire is bent such that the helical coil formed extends over at least a portion of the straight-line shank, as well as a portion of the angular portion of the hook-like shape, which prevents the helical coil from slipping off the supporting element and to support heavy pot planters. Although if the helical coil is tightly wrapped or the shank portion is rough, corrugated or otherwise treated or secured, the helical coil may be wrapped only around the straight-line shank portion of the supporting wire. In this manner, I provide an inexpensive, simple, strong and improved wire pot hanger suitable for use in securing and supporting planters.

For example, in one method of manufacture, three or more smaller-diameter straight wires, which are form-supporting wire elements, are clamp-positioned in a circumferential relationship about a larger-diameter straight supporting wire. The clamped large and smaller wires may be then cut to the desired length, if not at the desired length. Typically, the smaller-diameter wires are cut to a longer length, since they are the suspending wire stringer elements; e.g., 12 to 36 inches, while the larger-diameter wire is cut to a shorter length just suitable for being bent into a hook-like support element, and to form a shank portion of desired length; e.g., 2 to 6 inches. After the cutting operation, a chuck means, with a central hole and three or more prepositioned holes therein, is advanced and slides over the central supporting wire and to a position over the ends of the three smaller-diameter surrounding wires. The chuck means is then rotated about the central wire a predetermined number of times, while moved axially along the large-diameter wire, to twist the three or more positioned smaller stringer wires tightly about and to the larger-diameter supporting wire to form a straight-line helical coil of a predetermined length about the one of the straight large-diameter wire. The chuck, after rotation, is retracted and removed from the other free straight end of the large wire. Optionally, hooks are then formed in one operation at the free or other end of the bunched smaller-diameter wires. The larger-diameter supporting wires is formed into a hook-like shape having an angular portion which extends into a straight-line shank, with the helical coil preferably bent at the same time so that it extends into the angular portion of the shank as well as over at least a portion of the shank section of the supporting hook.

My wire pot hanger and method of preparing the same will be described for the purpose of illustration only in connection with the preferred embodiment. However, it is recognized that various changes and modifications may be made in the improved wire pot hanger and the method of preparing same by those persons skilled in the art which are within the spirit and scope of my invention.

DESCRIPTION OF THE EMBODIMENTS

Figure 1:
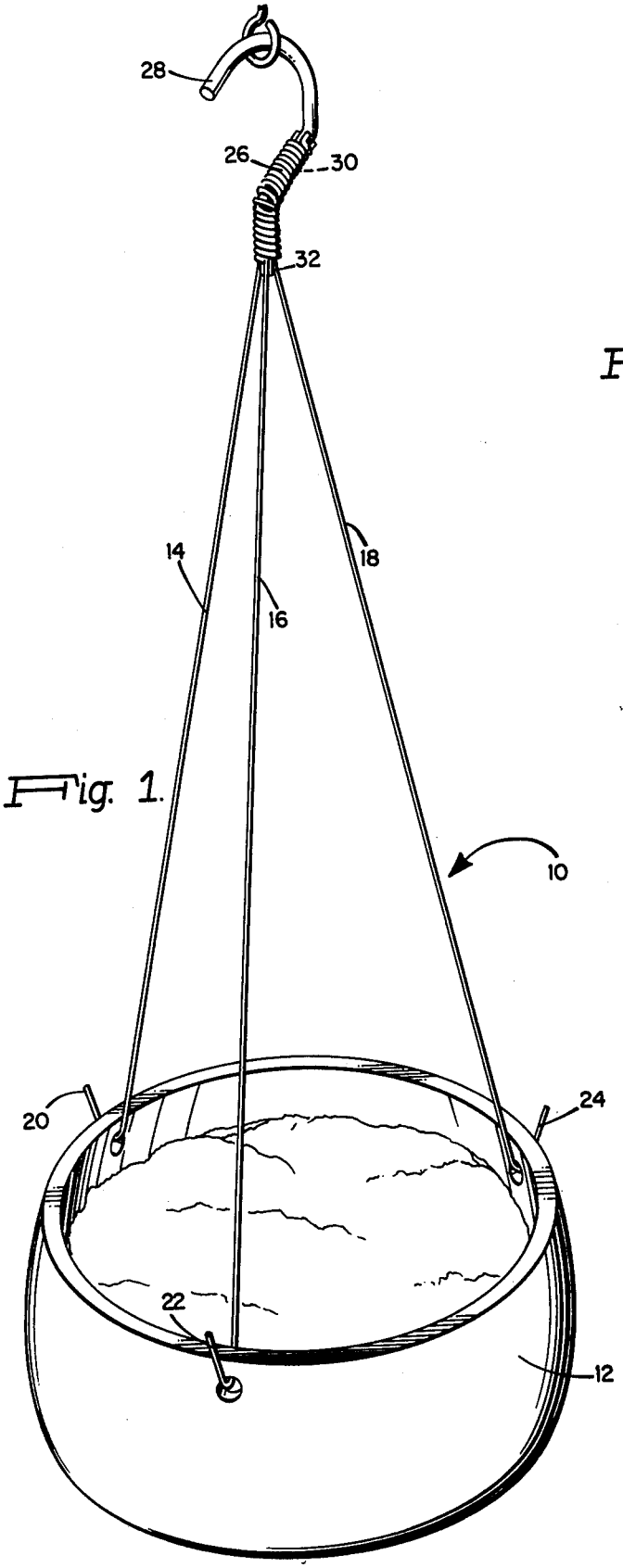
FIG. 1 is a perspective view of a planter showing an embodiment of my wire pot hanger supporting the planter.

FIG. 1 shows an improved pot hanger 10 with a suspended pot planter 12 containing soil therein, the planter pot supported by stringer wires 14, 16 and 18 with hooks 20, 22 and 24 at the end thereof. The hooks are secured to holes equally positioned about the other periphery of the planter 12, the stringer wires supporting the planter 12. At the other end is a helical coil 26 formed of the stringer wires 14, 16 and 18, the helical coil 26 wrapped about the straight shank portion 32 and the angular portion 30 of a larger-diameter hook-like supporting element 28 which serves as the supporting means to suspend the hanger from an eyelet hook in the ceiling. The angular portion 30 is bent typically at an angle of 30° to 60°, such as 45° as shown, from the straight shank portion 32. The helical coil 26 of the stringer wires 14, 16 and 18 about both the shank 32 and the angular portion 30 prevents the helical coil from slipping off the supporting hook element 28, and provides for a strong support to large-type planters. Typically, the supporting element is formed of a much larger-diameter metal wire or rod material to provide strength, and often has a diameter of from 1½ to 4 times the diamter of the smaller more flexible metal stringer wires. As illustrated, three stringer wires are employed; however, the number of stringer wires may vary as desired, but generally comprises two, three, four or more in number.

Figure 4:
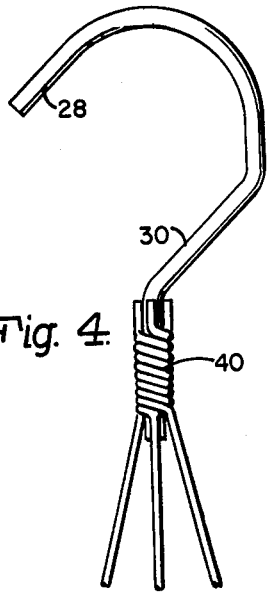
FIG. 4 is a partial perspective view of the supporting element of another embodiment of my pot hanger.

In another embodiment illustrated more particularly in the partial view of FIG. 4, a helical coil 40 of the wires 14, 16 and 18 is formed around the straight shank portion only of the supporting element 28, the helical coil being tightly wrapped around the supporting wire. This particular form is suitable for support of smaller or light-weight planters or objects.

Figure 5:
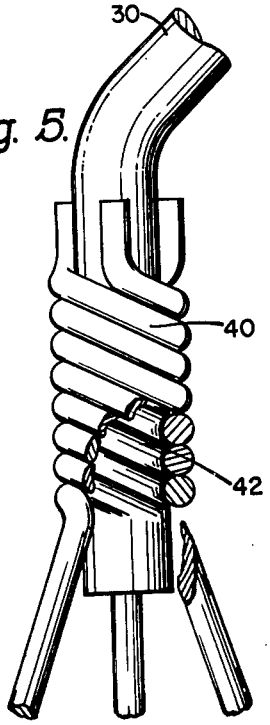
FIG. 5 is a partial perspective view with a partial cutaway cross-sectional view of a further embodiment of my pot hanger.

FIG. 5 is an enlarged partial perspective and cross-sectional view of a further embodiment, wherein the lower end of the shank portion supporting element 32 has its surface corrugated or ridged 42, so that the helical coil wrapped about the straight shank portion is secured thereto and is prevented from slipping off the straght shank portion. The corrugations or ridges on the supporting element may be used not only on the shank portion, but if desired, to and including the angular portion of the supporting element.

Figure 3:
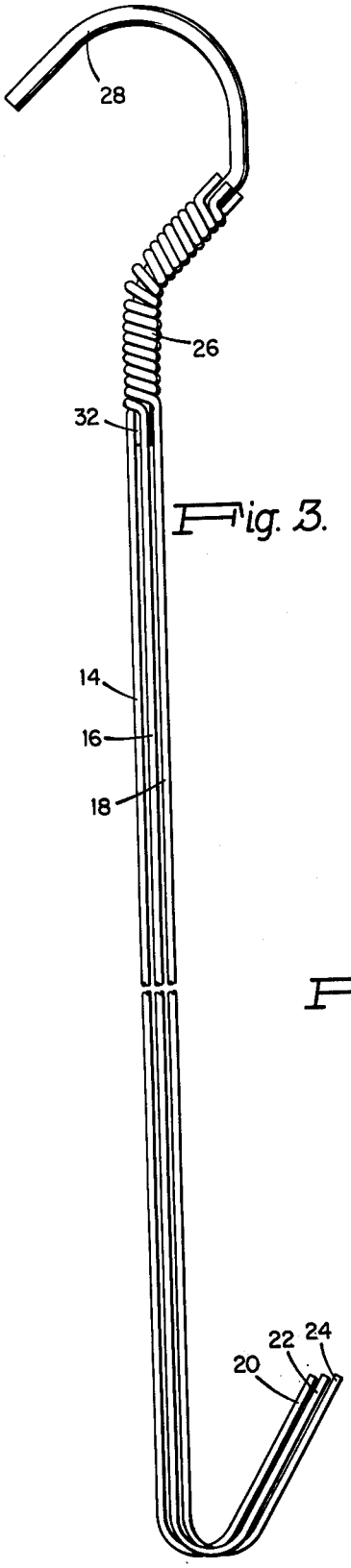
FIG. 3 illustrates my wire pot hanger after preparation and before use.
Figure 2B:
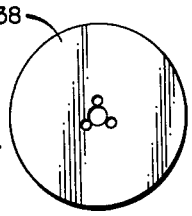
FIG. 2*b* is an end view of the chuck used in the method of FIG. 2*a*.
Figure 2A:
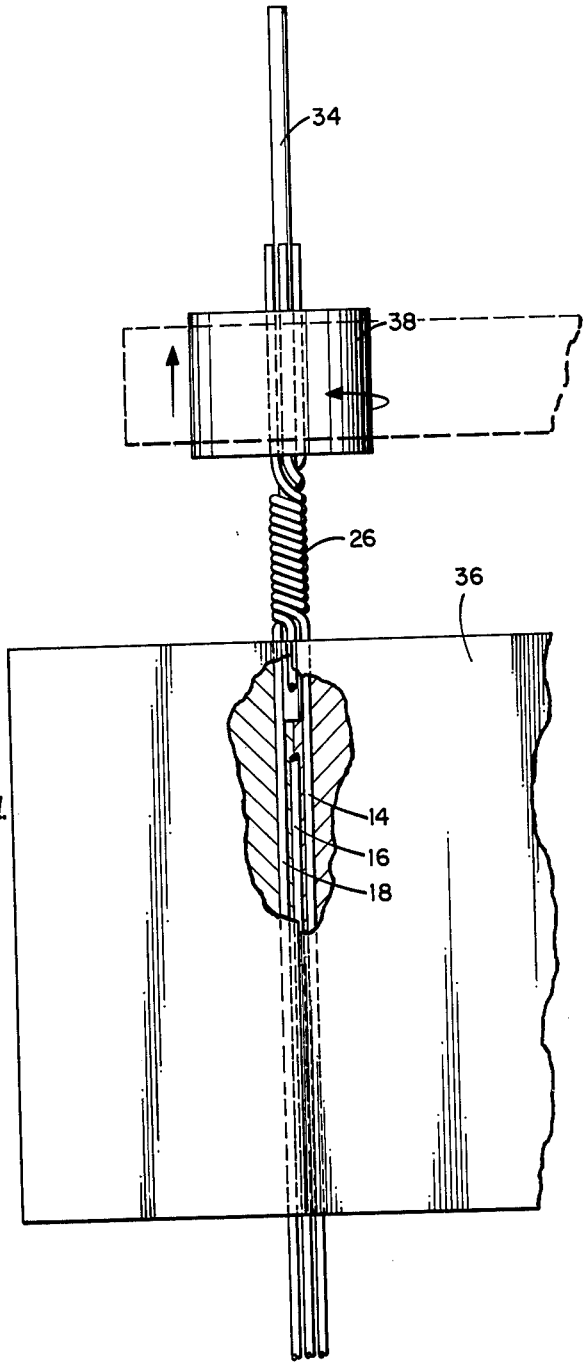
FIG. 2*a* illustrates one step in the method of preparing my improved wire pot hanger.

As shown more particularly in FIGS. *2a* and *2b* and FIG. 3, in the manufacture of my improved wire pot hanger, three straight stringer wires 14, 16 and 18 are equally positioned circumferentially about a central supporting straight larger-diameter wire 34 and are held in place by a clamp 36. The stringer wires 14, 16 and 18 and the support wire 34 are cut to the desired size. The stringer wires 14, 16 and 18 are positioned such that a predetermined length at one end is clamped over a portion at one end of the support wire 34. A check 38, adapted to be rotated and having a central passageway and three triangular passageways prepositioned therein and adapted to fit over the central support wire 34 and the stringer wires 14, 16 and 18, is axially advanced from the other to the one end of the support wire 34. The chuck 38, once positioned at the one end of the wire 34, is then rotated as illustrated and moved axially toward the other free end of the wire 34. The chuck 38, on rotation and axial movement, forms a tight helical contiguous coil of the stringer wires 14, 16 and 18 about the overlapping section of one end of the supporting wire 34. The axial and rotating movement of the chuck is illustrated by the directional arrows, and the movement means of the chuck by the dotted line device. Rather than have the stringer wires held stationary and the chuck 38 rotated and moved axially, the chuck 38 could be stationary and the other ends of the wires rotated, or both the other ends of the wires and the chuck rotated in opposite directions to form the helical coil on the straight support wire.

After the helical coil is formed, the chuck is then moved to the left as illustrated and withdrawn from its position about the wire 34.

After formation of the helical coil about the straight support wire, and as shown more particularly in FIG. 3, the one end of the supporting wire 34 is bent to form a hook-like or support element 28 from which the hanger is to be suspended. As illustrated, the element is bent to form an angular portion 30 typically at an angle of about 45° from the straight shank portion 32 of the support wire 34. At the other end of the wire stringers, hook elements 20, 22 and 24 are formed by bending in one operation. The hanger thus prepared and shown in FIG. 3 is ready to be shipped and used as a pot hanger by merely spreading the stringer wires to the desired angular-type configuration and securing to the planter.

My invention has been described for the purpose of illustration only employing metal wires as the stringer wires and as the supporting element in a particular method of preparing the improved pot hanger. However, it is recognized and is within the spirit and scope of my invention that other materials and techniques can be used in the practice of my invention.

What I claim is:

1. A method of manufacturing a hanger for use in supporting planters and the like, which method comprises the steps of:

a. providing a plurality of wire-stringer elements of predetermined length having a straight one end and another end;

b. providing a straight wire-support element having a one end and another end;

c. axially aligning the wire-stringer elements at the one end about the circumference of the wire-support element at the one end of the wire-support element, leaving the other end of the wire-support element free for the forming step (e);

d. twisting tightly the wire-stringer elements about the one end of the straight wire-support element to form a sequentially wrapped, helical coil of the wire-stringer elements about the one end of the straight wire-support element;

e. forming the other end of the straight wire-support element, which is free of the twisted helical coil, into a hook-like supporting means; and f. forming the other end of the straight wire-stringer elements, while axially aligned with the wire-support element, into securing means adapted to support pot planters and other objects.

2. The method of claim 1 which includes providing a straight wire-support element having a larger diameter than the diameter of the plurality of straight wire-stringer elements.

3. The method of claim 1 which includes providing a straight wire-support element having at the one end thereof a corrugated-type surface, about which the plurality of wire-stringer elements are twisted into a helical coil.

4. The method of claim 1 which comprises bending the other ends of the wire-stringer elements, while aligned with the wire-support element, into hook-like elements in a single operation, the hook-like elements adapted to be secured to a planter or object to be suspended.

5. The method of claim 1 which comprises forming the other end of the straight wire-support element, free of the helical coil, into a hook-like supporting means to provide a hook-like support element, a straight-line shank portion, and an angular element connecting the straight-like shank and the hook-like support, the helical coil wrapped and extending over only the straight-shank element.

6. The method of claim 5 which includes bending the helical coil wrapped about the one end of the wire-support means, whereby the helical coil extends over at least a portion of the angular element, as well as the straight-line shank element.

7. The method of claim 1 which includes:

a. providing a rotatable chuck element characterized by a central passageway therein and a plurality of peripheral passageways about the central passageway;

b. positioning the wire-support element within the central passageway of the chuck element and axially aligning the plurality of wire-stringer elements in the peripheral passageway of the chuck element;

c. rotating the chuck element, while providing axial movement between the chuck element and the central wire-support element, to form the said helical coil about the one end of the wire-support element; and d. removing the chuck element from the other end of the wire-support element prior to forming the other end of the wire-support element into a supporting means.

8. The method of claim 7 which includes:

a. clamping the wire-stringer elements at the one end to the wire-support element; and b. rotating the chuck element about the wire-support element, while moving the chuck element axially toward the other end of the wire-support element.

9. A method of manufacturing a hanger for supporting planters and the like, which method comprises the steps of:

a. providing a plurality of straight, small-diameter, wire-stringer elements of a predetermined length having a one end and another end;

b. providing a straight wire-support element having a larger diameter than the straight wire-stringer elements, said straight wire-support element having a one end and another end;

c. clamping, in an axially aligned position, the wire-stringer elements at the one end about the circumference of the straight wire-support element at the one end thereof, leaving the other end of the wire-support element free for a forming step to form a hook-like supporting means;

d. sliding a rotatable chuck element, characterized by a central passageway adapted to receive the wire-support element and a plurality of circumferential passageways about the central passageway and adapted to receive each of the wire-stringer elements, over the other end of the wire-support element and over the axially aligned wire-stringer elements and substantially to the one end of the wire-support element;

e. rotating the chuck element, while moving the chuck element axially toward the other end of the wire-support element, to twist tightly the plurality of wire-stringer elements about the one end of the central wire-support element to form a sequential, single-layer, helical coil about the one end of the wire-support element;

f. removing the chuck element;

g. forming the other end of the wire-support element into a supporting means which comprises a hook-like supporting element free of the helical coil, a straight-shank element and an angular element connecting the straight-shank element and the hook-like element, the helical coil extending and formed only over the straight-shank element; and h. forming the other ends of the wire-stringer elements, while axially aligned, in a single operation into securing elements adapted to be secured to planters and the like to be suspended.

10. The method of claim 9 which includes forming the other end of the wire-support element into a supporting means, by forming that portion of the wire-support element at the one end, wherein the helical coil extends and is formed over the straight-shank element and at least a portion of the angular element, but not over the hook-like element of the supporting means.

* * * * *

UNITED STATES PATENT OFFICE
CERTIFICATE OF CORRECTION

PATENT NO. : 4,084,624
DATED : April 18, 1978
INVENTOR(S) : Hubert J. Moineau

It is certified that error appears in the above-identified patent and that said Letters Patent are hereby corrected as shown below:

In column 5, claim 1, part a, line 60, delete "straight" and insert --straight-- after "plurality of" in line 59.

Signed and Sealed this

*Fifth* Day of *September 1978*

[SEAL]

*Attest:*

RUTH C. MASON
*Attesting Officer*

DONALD W. BANNER
*Commissioner of Patents and Trademarks*